US008062069B2

(12) United States Patent
Coester

(10) Patent No.: US 8,062,069 B2
(45) Date of Patent: Nov. 22, 2011

(54) SPARK FREE IMPROVED CONNECTOR

(76) Inventor: Oskar Hans Wolfgang Coester, Porto Alegre (BR)

( * ) Notice: Subject to any disclaimer, the term of this patent is extended or adjusted under 35 U.S.C. 154(b) by 0 days.

(21) Appl. No.: 12/920,700

(22) PCT Filed: Mar. 4, 2009

(86) PCT No.: PCT/BR2009/000061

§ 371 (c)(1),
(2), (4) Date: Nov. 8, 2010

(87) PCT Pub. No.: WO2009/109026

PCT Pub. Date: Sep. 11, 2009

(65) Prior Publication Data

US 2011/0053419 A1 Mar. 3, 2011

(30) Foreign Application Priority Data

Mar. 5, 2008 (BR) ..... 0800483

(51) Int. Cl.
*H01R 13/70* (2006.01)

(52) U.S. Cl. ..... 439/620.21; 439/188

(58) Field of Classification Search ..... 439/188, 439/620.21; 200/51.09
See application file for complete search history.

(56) References Cited

U.S. PATENT DOCUMENTS 3,496,500 A 2/1970 Romary
4,616,285 A 10/1986 Sackett

FOREIGN PATENT DOCUMENTS

DE 10148329 A1 4/2003
EP 0661912 A 7/1995

OTHER PUBLICATIONS

International Search Report dated Jul. 23, 2009, issued in corresponding international application No. PCT/BR2009/000061.

*Primary Examiner* — Briggitte R Hammond
(74) *Attorney, Agent, or Firm* — Ostrolenk Faber LLP

(57) ABSTRACT

A spark free connector that includes a case with removable end covers, each end cover having at least one cable gland; an internal board disposed inside the case and including a first connector connected to a line and a return line, and a second connector serially connected to the line and the return line via a magnetically switchable reed switch; and a magnet that is movable relative to the reed switch to magnetically operate the reed switch.

5 Claims, 9 Drawing Sheets

SPARK FREE IMPROVED CONNECTOR

CROSS REFERENCE TO RELATED APPLICATIONS

The present application is a 35 U.S.C. §371 National Phase conversion of PCT/BR2009/000061, filed Mar. 4, 2009, which claims benefit of Brazilian Application No. PI0800483-8, filed Mar. 5, 2008, the disclosure of which is incorporated herein by reference. The PCT International Application was published in the English language.

BACKGROUND OF THE INVENTION

This invention refers to an innovative connector for power grids and/or communication networks which does not cause a spark in the moment it is connected or disconnected.

It is known that in classified factory areas is where there is an explosion risk, such as areas which operate with an atmosphere contaminated with volatile liquids or inflammable particulates which need special equipment. This equipment is explosion proof and avoid the electric arcing resulting from the separating or approaching electrical conductors, causing the ignition of contaminants in the air.

On the other hand, the complex industrial installations, such as petroleum refineries and similar complexes, the actuators and other devices are remotely controlled through transmitted high frequency signals in a communication network. A control center equipped with the processing capacity automatically controls all the installation equipment.

A complex problem of these installations is to remove some piece of equipment for maintenance. At this moment the communication signals have to be switched off, by mechanical decoupling of the two parts which make up a network connector. All the known connectors have electro-mechanical contacts to close the communication network. However, even though the current for the communication signal is low, there is always a risk of an electric arcing, undesirable in environments with an inflammable atmosphere.

In another situation, it can be wished that only one specific piece of equipment is disconnected from the communication network without the whole network being interrupted, in other words, the network continues communicating with all the other pieces of equipment, what is commonly called hot swap disconnection.

SUMMARY OF THE INVENTION

Therefore, the objective of this invention is an improved connector which preferentially, operates in communication networks allowing the decoupling of the communication signal without a spark occurring. This is possible through a connector whose electrical contact between its two sides is made through, at least, a reed switch, e. g., a switch whose contacts are inside a hermetically sealed vacuum glass envelope and which is operated externally by a magnetic field. The communication signals, which should reach the equipment switched in the network through the invented connector, by being transmitted from one side to the other through reed switches.

In a first realization of the invention the removable covers of the connector have, at least, one magnet, so that when the connector is closed the magnet is positioned near the reed switches, which are then activated by the magnetic field. When the magnet is removed, without it being necessary to open the electrical contact of the connector, the magnet field ceases, this causes the filaments of the reed switch to disconnect and interrupts the communication signal between the sides of the connector.

In a second realization of the invention the connector has a control button, activated externally, which moves the magnet, removing it from or moving it to the reed switches, in a manner to switch on or off the connector, respectively, without it being necessary to move the removable cover.

The connector can be, alternatively, used only for the power grid or for both the power grid and the communication network.

The improved connector of this invention has the following advantages over other connectors known for the same function:

- It does not generate electrical arcing at the moment it is disconnected;
- it can be connected or disconnected hot, e. g., with the communication network operating, without effecting its functioning;
- it is especially appropriate for use in classified areas.

The improved connector of the invention can be better understood through the following detailed description, which is based on the annexed drawings, listed below, which illustrate the preferred realized forms, this design is merely an example, which should not be considered as the limit of the invention:

DESCRIPTION OF PREFERRED EMBODIMENTS

Figure 1:
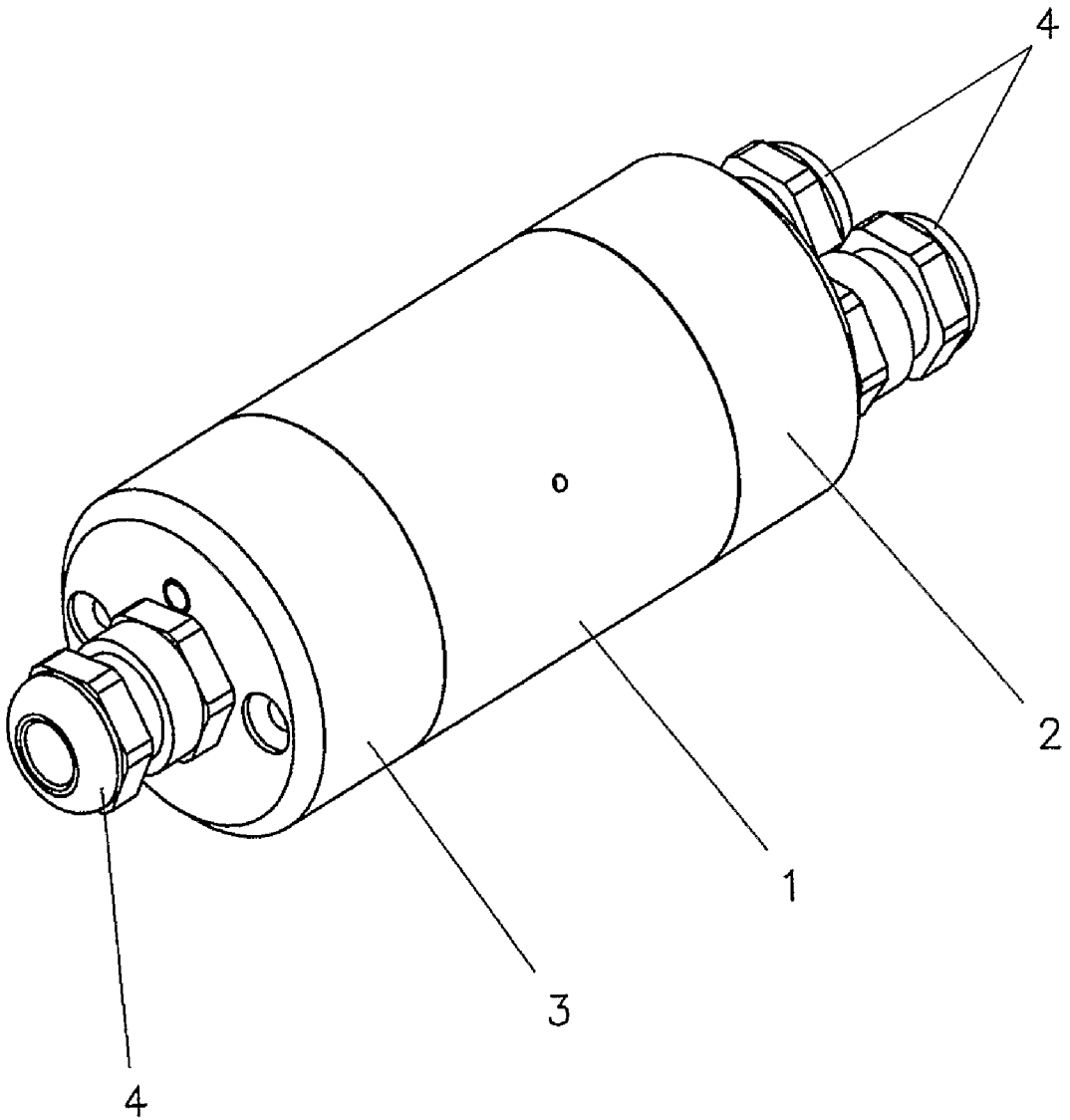
FIG. 1—front view of a first realization of the connector.
Figure 2:
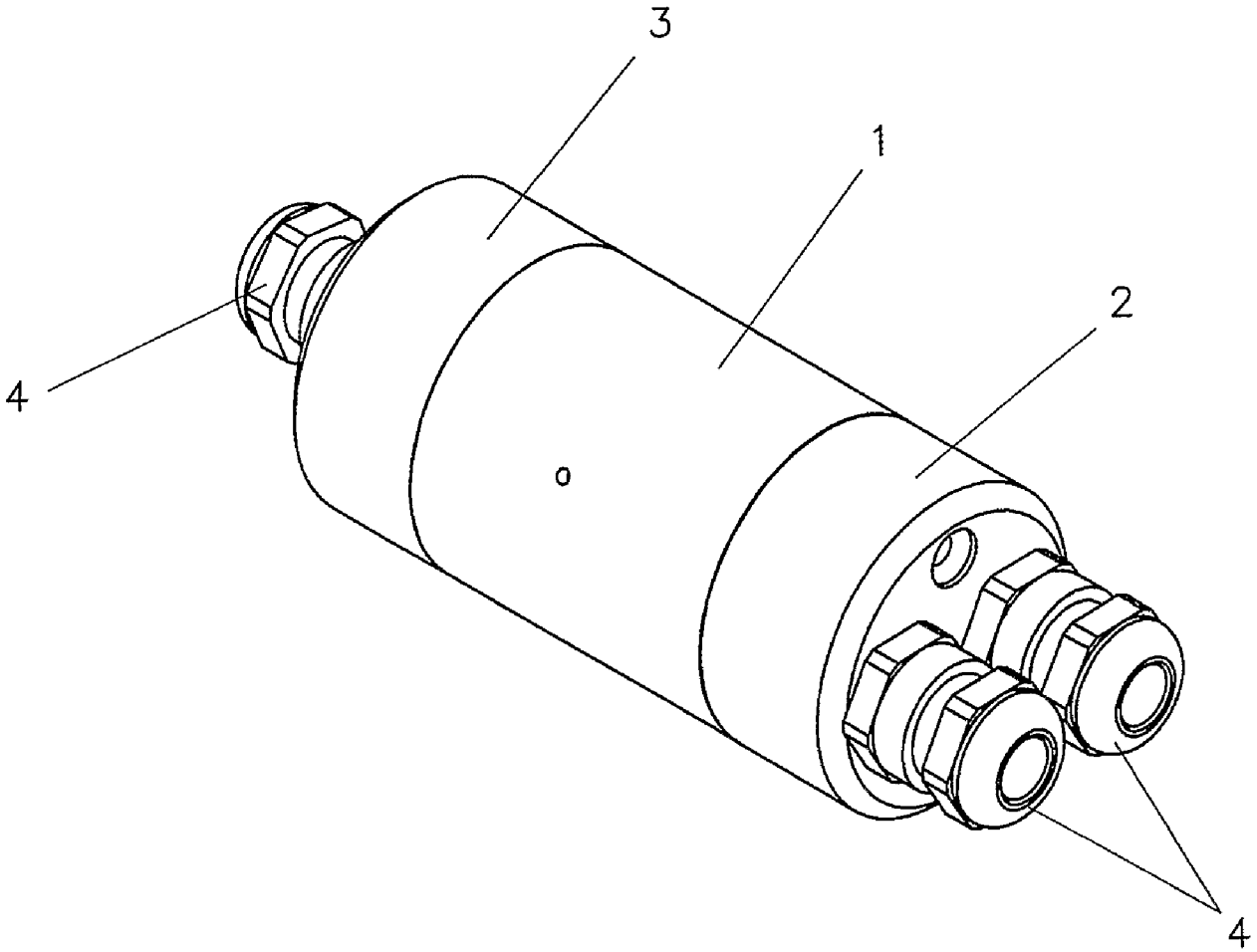
FIG. 2—rear view of the realization of the connector.

FIGS. 1 and 2 illustrate a first realization of the improved connector of the invention which comprises a casing (1), with removable end covers (2 and 3). Each of the removable covers (2 and 3) have, at least, a cable gland (4) to connect the conductors to the connector.

Figure 3:
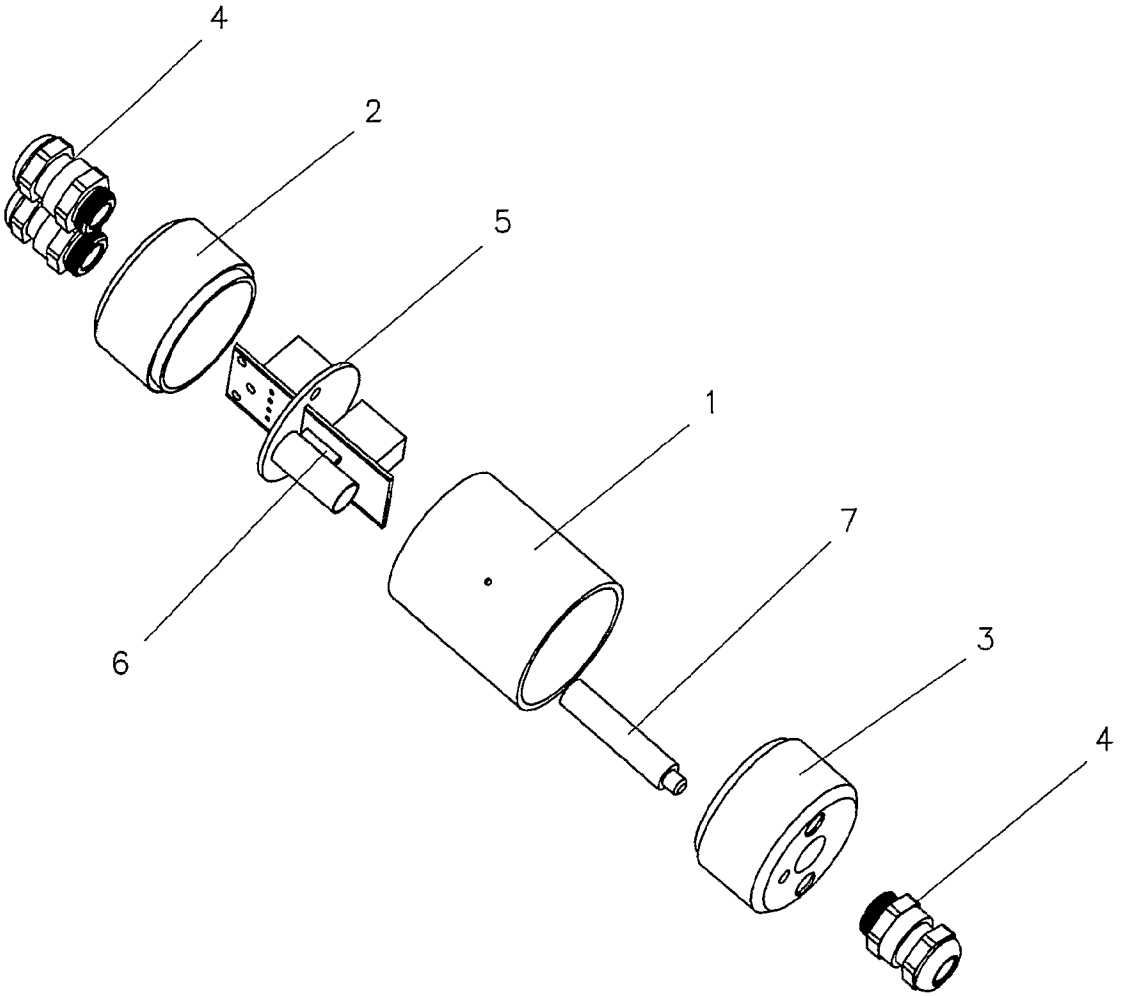
FIG. 3—exploded view of the realization of the connector.
Figure 4:
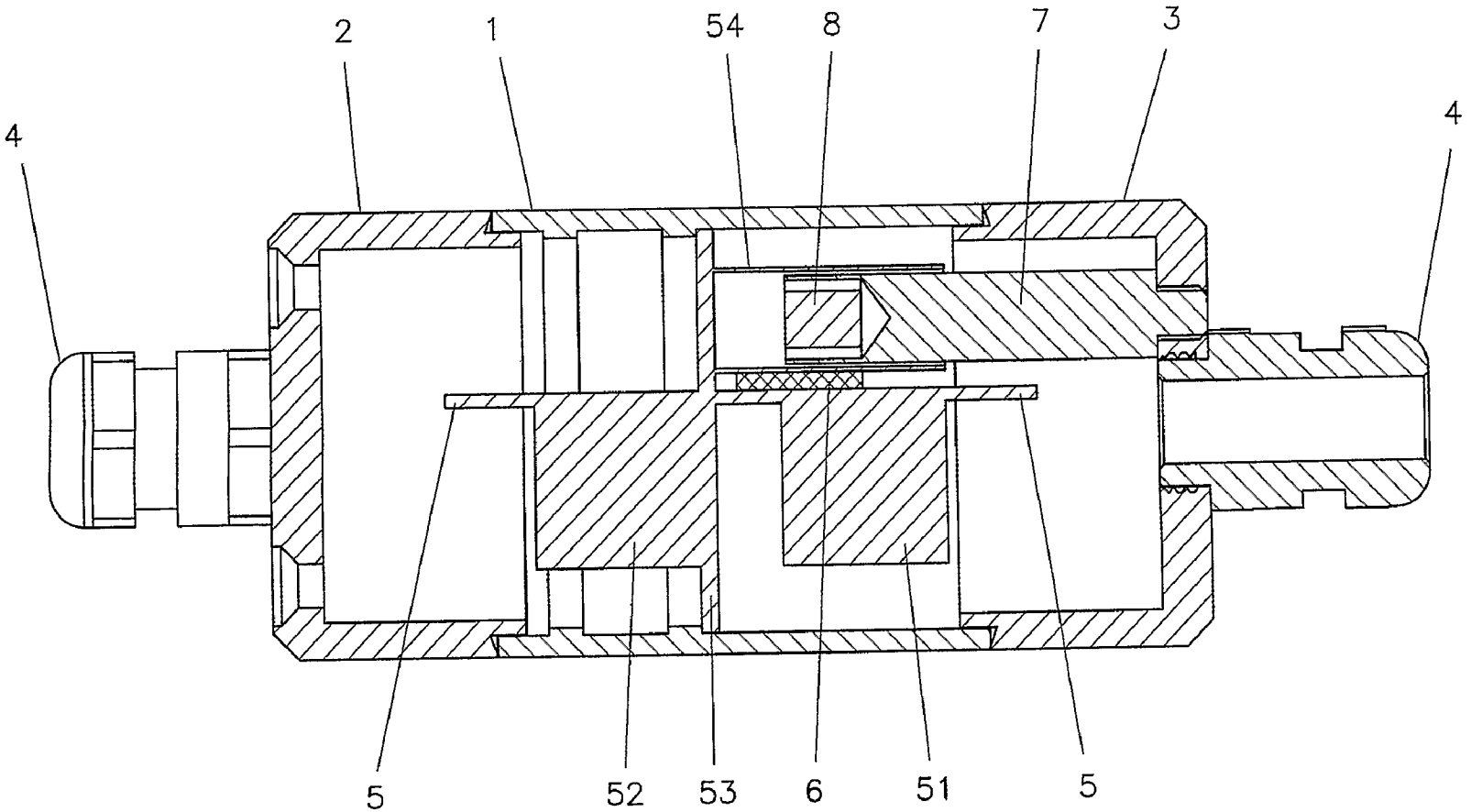
FIG. 4—cross section view of the connector.
Figure 6:
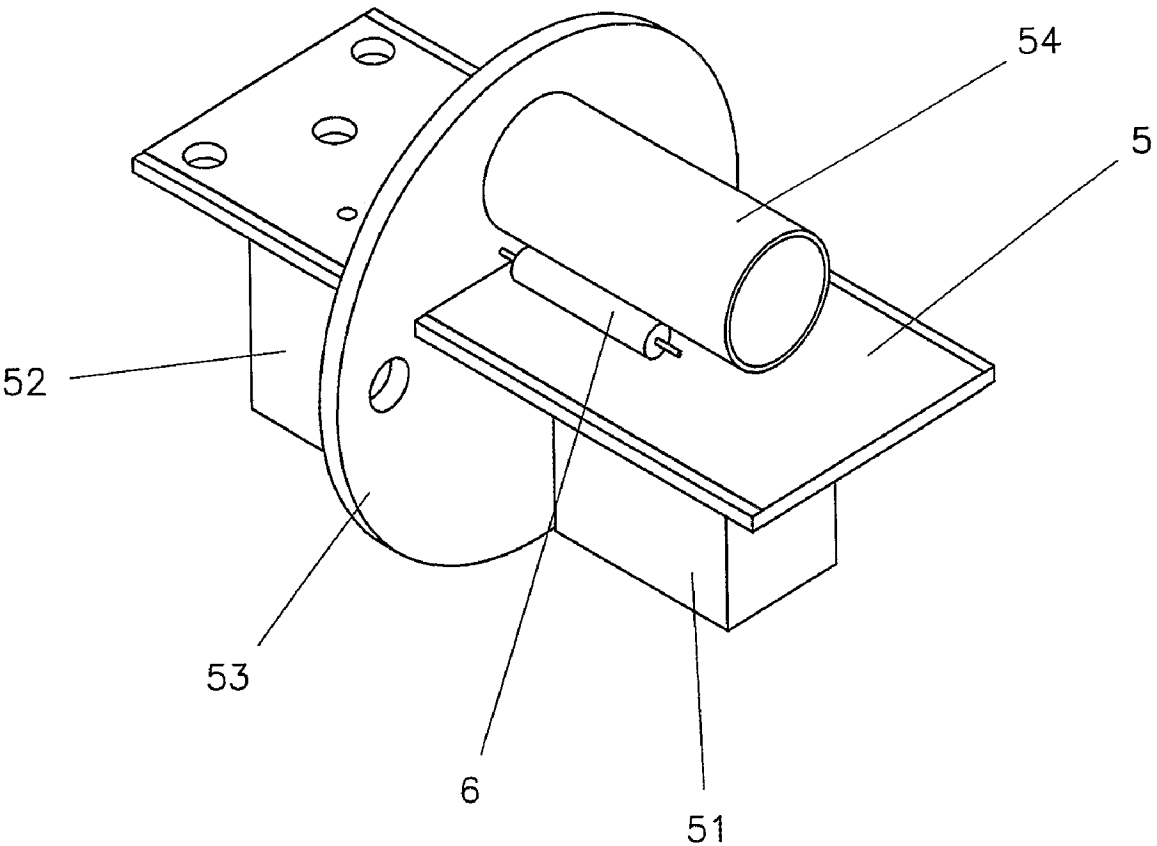
FIG. 6—view of the connector internal board.

The FIGS. 3 and 4 detail the internal components of the connector which consist of an internal board (5) where the conductors are connected which consists of conductor connection bars (51 and 52) and a central support (53) for fastening to the casing (1) of the connector, better shown in FIG. 6. A chamber (54) is fastened on the support (53). The reed switches (6) are interconnected on the board (5) which in turn is interconnected, through the bars (51 and 52) on the conductors. In this way, when the reed switches (6) are under the influence of the magnetic field, the signal passes from one side to the other of the connector.

Figure 5:
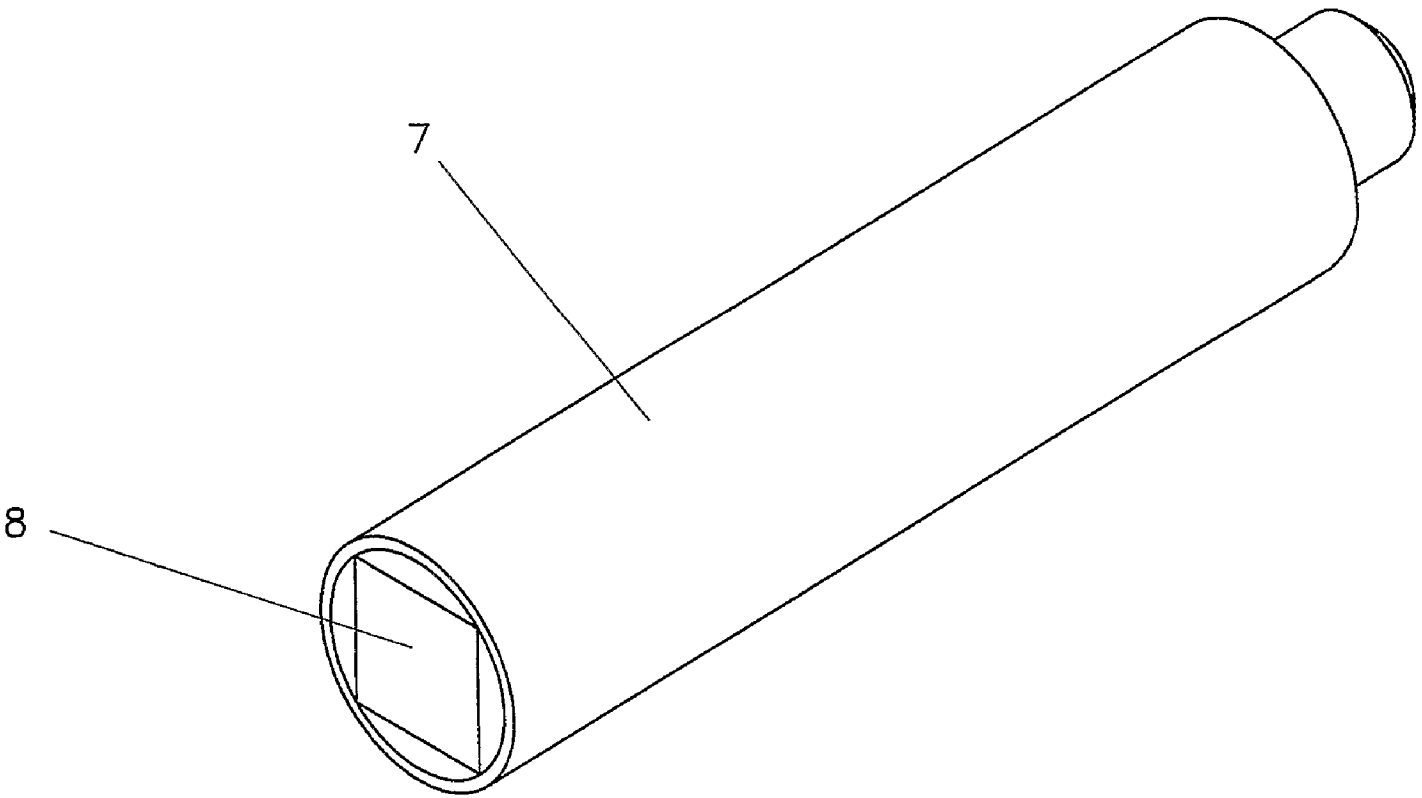
FIG. 5—view of the magnet support.

On the input removable cover (3) is fastened a rod (7) with a magnet at the end (8), illustrated separately in FIG. 5, whose group penetrates into the chamber (54) when the connector is mounted. At this moment, the magnet (8) is near the reed switches (6) generating a magnetic field which attracts its internal filaments, interconnecting or separating them, according to the type of reed switch used.

When it is necessary to switch off the connector without a spark occurring, the screws (not illustrated) of the cable glands (4) of the input removable cover (3) are loosened, allowing the cover to slide (3) on the conductors, which will remove the magnet (8) from the reed switches (6) switching off its internal filaments and interrupting the passing of the electrical signal.

Figure 7:
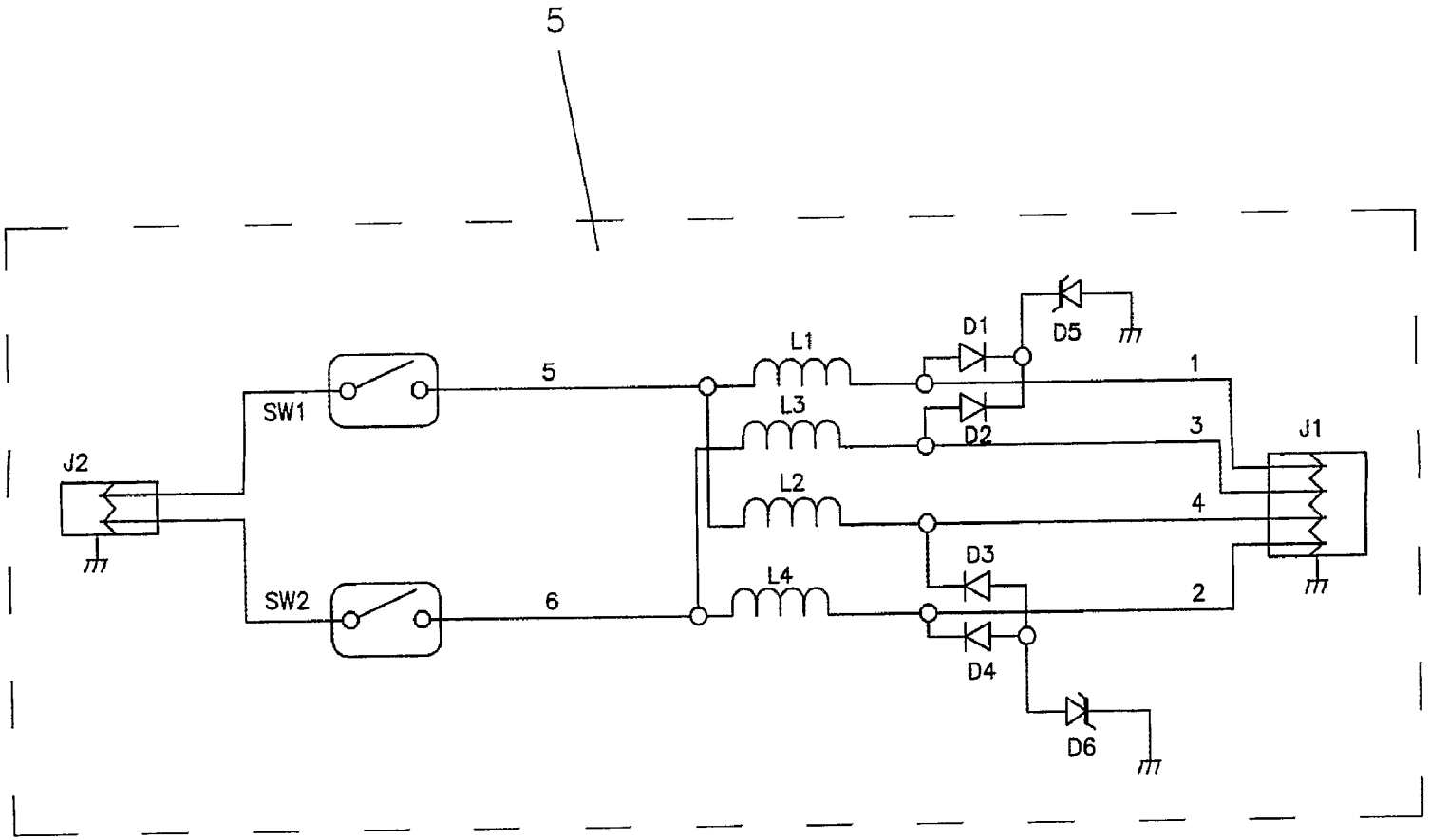
FIG. 7—block diagram of the connector internal board.

FIG. 7 illustrates a preferred circuit on the board (5) which consists of the conductors (J1 and J2), reed switches (SW1, SW2), micro-inductors (L1, L2 L3 and L4) and diodes (D1, D2, D3, D4, D5 and D6). The connector (J1) serves as the mechanical switching of the conductors of the communication network, whose line (1) returns through line (4) after passing through the micro-inductors (L1 and L2), which act as a frequency filter and through the diodes (D1 and D6), which act as rectifiers to protect against transient voltages. The same happens with line (2), which returns through line (3), after passing through the micro-inductors (L3 and L4) and through the diodes (D1 and D6), giving continuity to the communication network. The lines (1 and 2) have deviations (5 and 6) respectively to feed the equipment to be controlled through the network, using connector (J2). On the lines (5 and 6) are placed the reed switches (SW1 and SW2), which allow the interruption of the signal to the equipment, by opening the cover (3), illustrated in the figures before, without switching off the network and without any unwanted sparks in classified areas.

Figure 9:
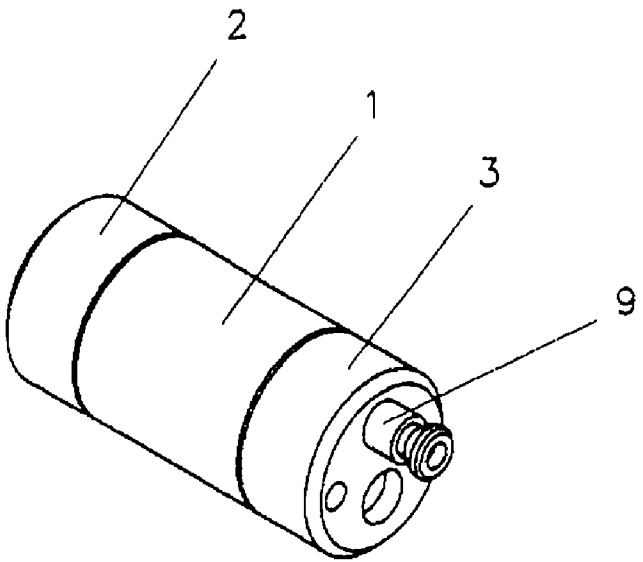
FIG. 9—rear view of the second realization of the connector.
Figure 8:
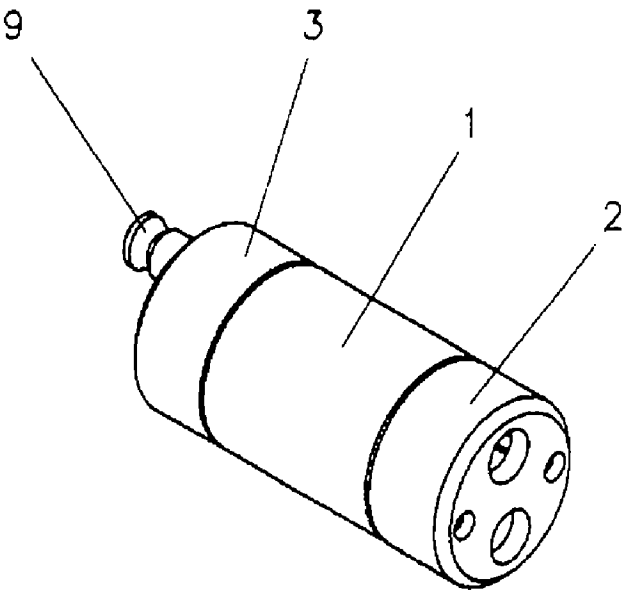
FIG. 8—front view of the second realization of the connector.
Figure 10:
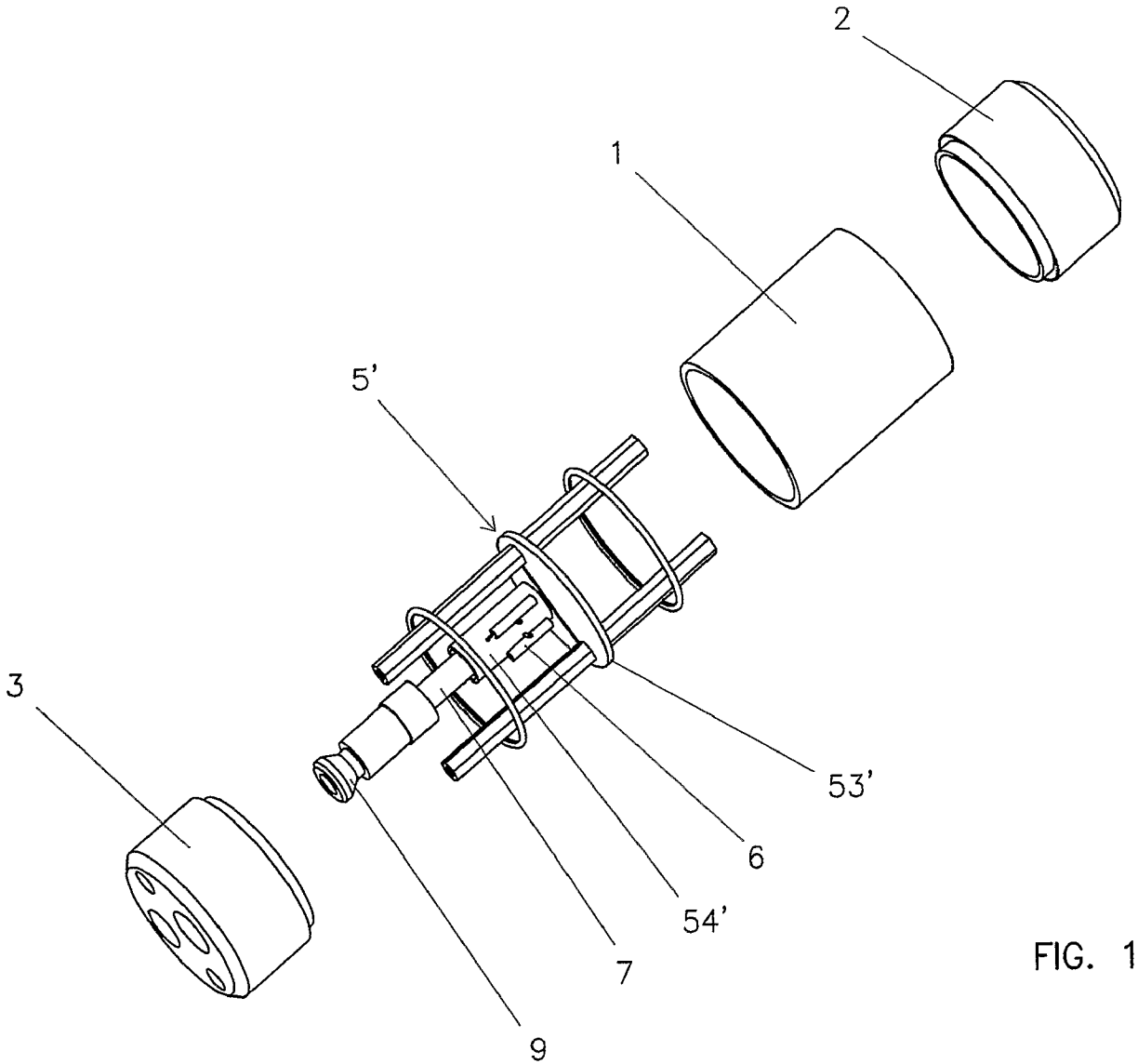
FIG. 10—exploded view of the second realization of the connector.

FIGS. 8, 9 and 10 illustrate a second realization of the improved connector invention which has a control button (9), externally operated which moves the magnet placed at the end of the rod (7) to the inside of the chamber (54'), which is unified with the central support (53') of the board (5'). Near the chamber (54') are placed the reed switches (6) which are influenced by the magnetism of the magnet. Through the external button operation (9) it is possible to separate or bring together the reed switches (6) to the magnet on the bar (7) in a way to disconnect or connect the connector, respectively, without the necessity of moving the removable cover (3).

What is claimed is:

1. A spark free connector comprising a case with removable end covers, each end cover having at least one cable gland;

an internal board disposed inside the case and including a first connector connected to a line and a return line, and a second connector serially connected to the line and the return line via a magnetically switchable reed switch; and a magnet that is movable relative to the reed switch to magnetically operate the reed switch.

2. A spark free connector according to claim 1, wherein the internal board comprises a circuit that includes a plurality of conductors, a plurality of reed switches, a plurality of micro-inductors and a plurality of diodes.

3. A spark free connector according to claim 1, wherein the internal board includes conductor connection bars, a central support that is fastened to the case of the connector; and a chamber.

4. A spark free connector according to claim 1, wherein a rod is attached at one end to the magnet and is fastened to one of the removable end covers at an opposite end thereof.

5. A spark free connector according to claim 3, further comprising, a rod attached at one end to the magnet and a control button outside the case and attached to an opposite end of the rod, at the end of the rod to the inside of the chamber unified on the central support of the board.

* * * * *